United States Patent [19]

Hoshino, deceased

[11] Patent Number: 4,681,011

[45] Date of Patent: Jul. 21, 1987

[54] TREMOLO ARM MOUNTING FOR STRINGED INSTRUMENT

[75] Inventors: Masao Hoshino, deceased, late of Owari Asahi; by Yoshihiro Hoshino, legal representative, Nagoya, both of Japan

[73] Assignee: Hoshino Gakki Co., Ltd., Japan

[21] Appl. No.: 741,445

[22] Filed: Jun. 5, 1985

[30] Foreign Application Priority Data

Jun. 7, 1984 [JP] Japan ..... 59-084740

[51] Int. Cl.[4] ..... G10D 3/12

[52] U.S. Cl. ..... 84/313; 84/267

[58] Field of Search ..... 84/313

[56] References Cited

U.S. PATENT DOCUMENTS

| | | | |
|---|---|---|---|
| 2,972,923 | 2/1961 | Fender | 84/313 |
| 4,457,201 | 7/1984 | Storey | 84/313 |
| 4,512,232 | 4/1985 | Schaller | 84/313 |

*Primary Examiner*—Lawrence R. Franklin

*Attorney, Agent, or Firm*—Ostrolenk, Faber, Gerb & Soffen

[57] ABSTRACT

A tremolo arm for the tremolo plate of a stringed musical instrument wherein the portion of the arm which is received in the tremolo plate is provided with recesses in which are disposed respective annular plastic rings that engage the underside of a sleeve on the tremolo plate. This construction obviates unwanted and unintended vibration.

11 Claims, 4 Drawing Figures

FIG. 3
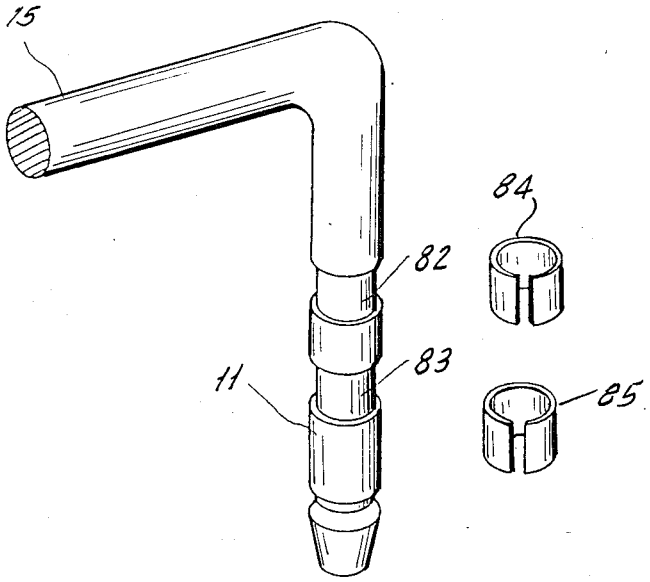
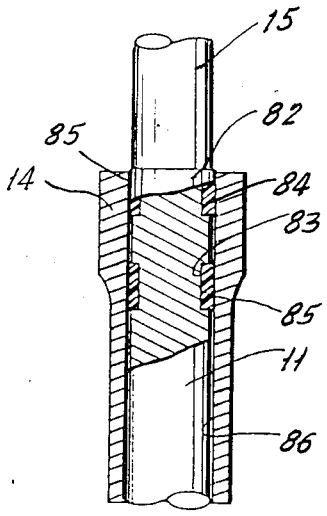
FIG. 4

TREMOLO ARM MOUNTING FOR STRINGED INSTRUMENT

BACKGROUND OF THE INVENTION

The present invention generally relates to stringed instruments, such as guitars, and more particularly to the tremolo therefor, and still more particularly to the mounting of the tremolo operating arm to avoid its unwanted vibration during playing. This invention may be used with the tremolo device shown in the applications entitled "Fine Tuning Mechanism for Guitars and the Like Stringed Instruments", Ser. No. 729,671; entitled "String Retaining Mechanism for Stringed Instruments Such as Guitars", Ser. No. 738,055, by the assignee hereof.

To obtain a temporary pitch change, the bridge region of the guitar may be provided with a tremolo plate, and rocking of that plate by a tremolo arm temporarily adjusts the string tension.

The tremolo arm is installed in a hole in the tremolo plate, e.g. a hole in a receiving sleeve. There is always a slight gap between the part of the arm that is installed in the hole in the tremolo plate and the wall of the receiving hole into that plate, irrespective of whether a rotatable compressive insertion structure for holding the arm in the plate is used or a screw-in connection is used. During playing and with the continued operation of the arm, there is an undesirable slight shaking of the tremolo arm which is amplified at the tip of the arm. This may make the instrumentalist uncomfortable.

SUMMARY OF THE INVENTION

Accordingly, the principal object of the present invention is the provision of a mounting for the tremolo arm so that the tremolo arm will be held in such a manner that it will not vibrate when the guitar is played by the instrumentalist.

According to the invention, the downward extension portion of the tremolo arm is received in a sleeve which may simply be formed as a hole in the tremolo plate, or which may be an inserted hollow bolt disposed in the tremolo plate. Around the downward extension portion is one or a plurality of compressible members which engage both the tremolo arm and the sleeve interior wall and prevent vibration of the arm. Particularly where the arm may be rotated in orientation during its use, the compressible member is a ring of a material which will permit the rotation. The ring may be split. The downward extension may have grooves to receive the respective compressible member.

The foregoing and other objects and features of the present invention will become apparent in the following description and accompanying drawings.

BRIEF DESCRIPTION OF THE DRAWINGS

FIG. 3 is an expanded view of the tremolo arm showing the present invention.

FIG. 4 is a cross-sectional view showing the installed portion of the tremolo arm in position on the tremolo.

DESCRIPTION OF THE PREFERRED EMBODIMENTS

A brief description of the tremolo and its manner of operation is described.

Figure 1:
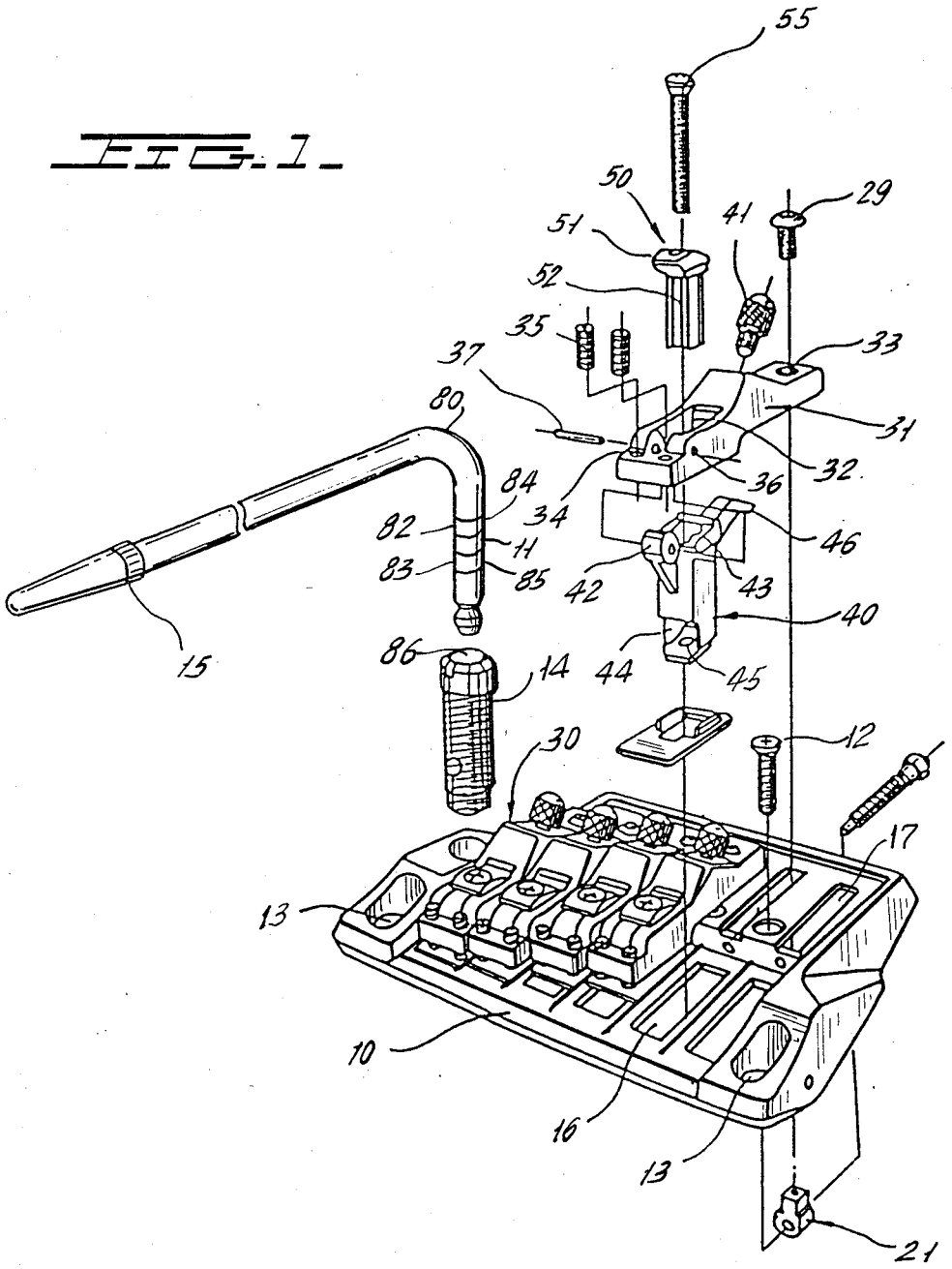
FIG. 1 is an expanded perspective view of a tremolo for carrying the rear end of the strings of a guitar and having the tremolo arm of the present invention.

FIG. 1 shows a tremolo plate which carries a fine tuning mechanism. The tremolo plate 10 is mounted on a guitar (not shown) by means of retaining screws which fit through the tremolo plate to guitar body screw holes 13. The tremolo plate contains two rows of grooves, the forward row 16 and the rearward row 17. Each pair of grooves is provided for one string. A bridge saddle 30 is located above each groove pair.

To the saddle 30 is attached a pitch tuning string tension adjusting mechanism. The mechanism includes a tuning member 40 which passes through the groove 16 in the tremolo plate 10. The tuning member 40 includes a pivot bearing supported on the saddle. The tuning member 40 includes a generally horizontally extending operating arm 46 and a downward tubular extension with a cutout section 44 for holding the guitar string as described below. The bottom of the extension is provided with a threaded screw receiving hole 45.

Figure 2:
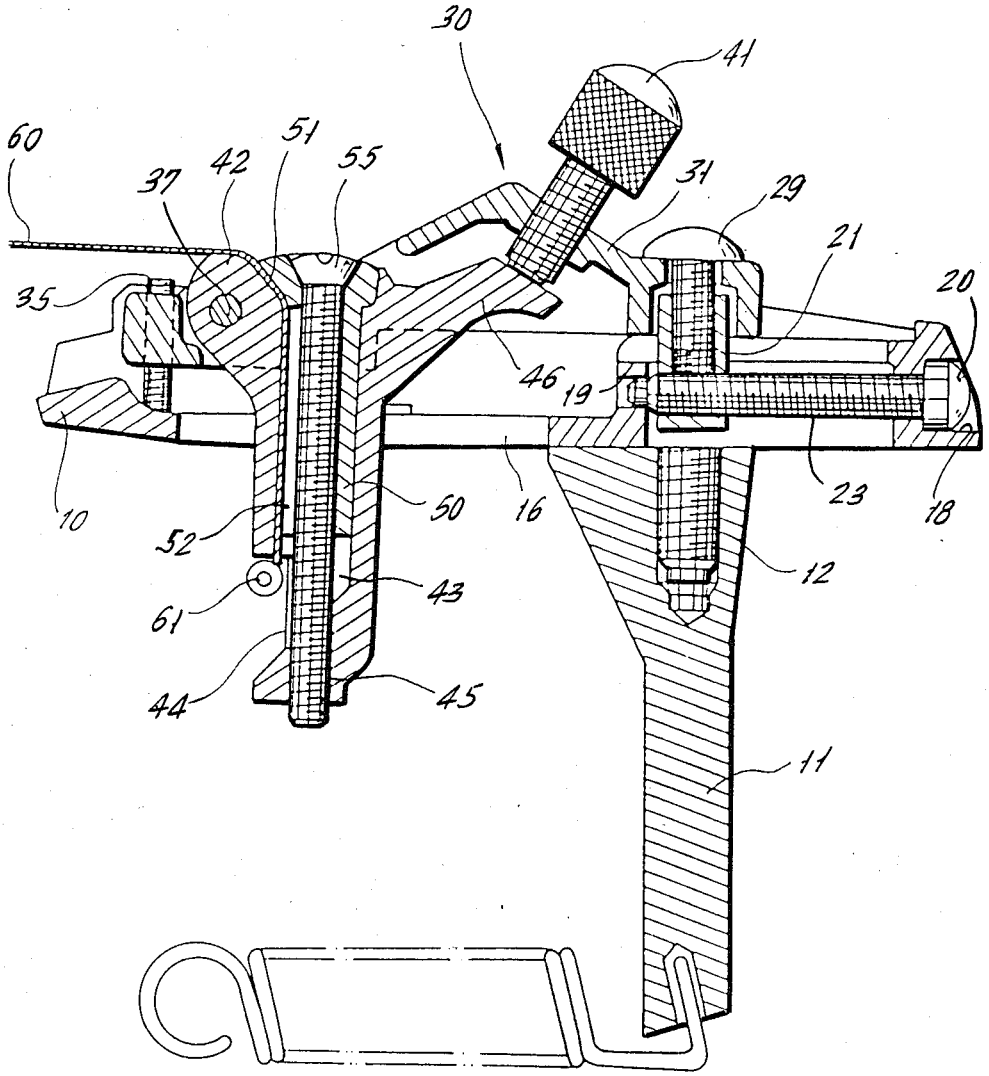
FIG. 2 is a side view partly in section of the tremolo of FIG. 1.

The tuning member 40 is supported in the front cutout 32 in the body 31 of bridge saddle 30. The bearing 42 of the tuning member 40 has an axial hole which is aligned with axial holes 36 in the body 31. The bearing 42 is fixed in position to the body 31 by means of an axial pin 37 which penetrates the axial holes and the bearing and enables the tuning member to pivot. The tuning member 40 is pivotable in one direction by the pull of the attached guitar string and in the other direction by pressing down on its arm 46. A pitch fine tuning screw 41 is screwed into the main body 31 from above to engage the arm 46 to control the pivoting of the tuning member 40. The end of the guitar string 60, shown in FIG. 2, is strung over the bearing 42 and is hooked in the cutout portion 44.

To clamp the string 60 in place, a string securing member 50 is inserted into the cutout 32 in the body 31. The fixed jaw 51 of the string securing member 50 bears against the string 60 and presses it to the tuning member in the vicinity of the bearing surface 42. A string retaining screw 55 passes through the string securing member 50 and is threadedly received in threaded hole 45 located in the tuning member 40. Tightening the screw 55 presses down the jaw 51 to hold the string in place. The section of the string between the bearing 42 and the cutout 44 passes through a groove 52 in the string fixing member 50. The accommodating portion 43 of the tuning member 40 is generally shaped to accommodate the string securing member 50 thereon.

Further assembly of the bridge saddle 30 is completed by inserting height adjustment screws 35 into the corresponding threaded holes 34 located in the body 31 of the bridge saddle 30. The bridge saddle 30 thus assembeled is lowered onto the tremolo plate 10, the tuning member penetrating through the groove 16 and extending below it. The saddle 30 is connected to the tremolo plate 10 by means of the securing screw 29 which passes through an opening 33 and which engages the guide member 21. The harmonic tuning screw 20 passes through the guide member 21 and is adapted to move the guide member 21 back and forth along the groove 17 as the screw 20 is rotated.

The tremolo operating arm 15 is associated with a hollow tremolo arm bearing sleeve in the form of a receiving bolt 14. In assembled form, the bolt 14 is secured to the base 10 and it receives the tremolo arm 15. During use, the arm 15 can be pulled to pivot the tremolo plate 10 around its front end and with respect to the guitar body, thereby to selectively relax or increase the tension on all of the strings.

The guide member includes a threaded hole 23 along the length dimension of the guitar. The hole 23 as shown in FIG. 2 accommodates the harmonic tuning screw 20. The narrowed tip of the screw 20 is received in an opening 19 which is defined in the tremolo plate 10. The head for turning the screw 20 is accommodated in an opening 18 in the tremolo plate 10. Rotation of the screw 20 moves the guide member forwardly and rearwardly in the groove 17.

The specific operation of the fine tuning mechanism is described in the applications mentioned above. The structure is also fully described here and requires no further description for the purpose of describing the present invention.

The downward extension 80 of the tremolo arm 15 which fits into the hole 86 of the receiving bolt 14 may become slightly loose, especially after continued use over a substantial period of time. The longer portion 80 of arm 15 is provided with at least one, and preferably a plurality, of annular concave or indented sections 82, 83. The heights of the ring-shaped concave areas 82 and 83 is preferably approximately 4 millimeters and the depth thereof is approximately 1 millimeter, as an example.

Appropriate plastic rings 84, 85 are inserted into sections 82. The rings are arranged so that they will be compressed when the downward extension 80 of the tremolo arm 15 is inserted into the opening in the bolt 14. The rings 84 and 85 have such a thickness that when they are inserted into the indented or concave sections 82, 83, they may slightly protrude by an amount in the range of 0.1 to 0.3 millimeters from the outer peripheral surface of the arm base 80. The rings 84, 85 may also, as shown, be in the shape of a split ring for convenience in installation, as well as efficiency as a packing.

It is preferable that the rings 84, 85 be constructed from materials whose main ingredient is a plastic having fatigue resistance and wear resistance as a polyamide resin such as nylon, or a polyacetal resin. As one example, a material comprising polyacetal resin with the added mixture of 10% Teflon, has been used for this purpose of improving the lubricating property thereof.

Therefore, the tremolo arm 15 is firmly held without developing any unwanted vibration during guitar and tremolo operation.

In the foregoing, the present invention has been described solely in connection with a preferred embodiment thereof. Since many variations and modifications of the present invention will now be obvious to those skilled in the art, it is preferred, therefore, that the present invention be limited not by the specific disclosure herein, but only by the appended claims.

What is claimed is:

1. A tremolo plate for a stringed musical instrument having a plurality of strings secured to the tremolo plate;

a tremolo arm having a handle section and a downward extension, the downward extension being connected to the tremolo plate, the handle section being movable by the instrumentalist;

a bearing sleeve mounted to the tremolo plate for receiving the downward extension of the tremolo arm, rigidifying means at the downward extension of said tremolo arm in the sleeve to rigidify the connection of the tremolo arm at the bearing sleeve for preventing shaking of the arm; the rigidifying means comprising a compressible member on the downward extension in the sleeve for engaging both the downward extension and the sleeve around it.

2. The tremolo plate of claim 1, wherein the compressible member is sized and of a material to enable the tremolo arm to be rotated without loosening its support in the sleeve.

3. The tremolo plate of claim 1, wherein the compressible member comprises a plastic material having an added mixture of the order of 10% of Teflon.

4. The tremolo plate of claim 1, wherein the compressible member is comprised of a polyacetal resin.

5. The tremolo plate of claim 1, wherein there are a plurality of compressible members along the downward extension.

6. A tremolo plate for a stringed musical instrument having a plurality of strings secured to the tremolo plate;

a tremolo arm having a handle section and a downward extension, the downward extension being connected to the tremolo plate, the handle section being movable by the instrumentalist;

a bearing sleeve mounted to the tremolo plate for receiving the downward extension of the tremolo arm, rigidifying means at the downward extension of said tremolo arm in the sleeve to rigidify the connection of the tremolo arm at the bearing sleeve for preventing shaking of the arm; the downward extension of the tremolo arm being provided with at least one groove; and a compressible member in the groove and sized for engaging both the downward extension and the bearing sleeve around the downward extension to provide a pressurized relationship.

7. The tremolo plate of claim 6, wherein the compressible member comprises a Nylon material.

8. The tremolo plate of claim 6, wherein the compressible member is sized and of a material to enable the tremolo arm to be rotated without loosening its support in the sleeve.

9. The tremolo plate of claim 6, wherein there are a plurality of the recesses and a respective plurality of the compressible members.

10. The tremolo plate of claim 6, wherein the groove in the downward extension and the compressible member are both annular.

11. The tremolo plate of claim 10, wherein the compressible member comprises a split ring.

* * * * *